US005392497A

United States Patent [19]

Defner

[11] Patent Number: 5,392,497

[45] Date of Patent: Feb. 28, 1995

[54] MAGNETIC CLASP

[76] Inventor: Jesus E. G. Defner, Wiesingerstrasse 3/29, A-1010 Vienna, Austria

[21] Appl. No.: 952,904

[22] PCT Filed: May 16, 1990

[86] PCT No.: PCT/AT90/00046

§ 371 Date: Jan. 15, 1993

§ 102(e) Date: Jan. 15, 1993

[87] PCT Pub. No.: WO91/17675

PCT Pub. Date: Nov. 28, 1991

[51] Int. Cl.[6] ..... A44B 1/04; E05C 17/56

[52] U.S. Cl. ..... 24/303; 292/251.5

[58] Field of Search ..... 24/303, 49 M; 292/251.5; 335/285; 248/206.5

[56] References Cited

U.S. PATENT DOCUMENTS

| | | | |
|---|---|---|---|
| 2,637,387 | 5/1953 | Goodman et al. . | |
| 3,086,268 | 4/1963 | Chaffin . | |
| 3,129,477 | 4/1964 | Mizuno . | |
| 3,376,616 | 4/1968 | Kaczorowski | 24/303 |
| 4,121,324 | 10/1978 | Marbacher . | |
| 4,231,137 | 11/1980 | Fujimoto . | |
| 4,241,605 | 12/1980 | Hendriks et al. | 73/861.94 |
| 4,265,002 | 5/1981 | Hosken | 24/303 |
| 4,505,007 | 3/1985 | Aoki | 24/49 M X |
| 4,991,270 | 2/1991 | Aoki | 292/251.5 X |
| 5,099,659 | 3/1992 | Carranza et al. | 24/303 X |
| 5,253,394 | 10/1993 | Morita | 24/303 |

FOREIGN PATENT DOCUMENTS

| | | | |
|---|---|---|---|
| 2448873 | 9/1980 | France . | |
| 2628052 | 1/1977 | Germany . | |
| 559134 | 2/1944 | United Kingdom | 335/285 |
| 1560248 | 1/1980 | United Kingdom . | |
| 2026079A | 1/1980 | United Kingdom . | |
| 2045335A | 10/1980 | United Kingdom . | |

*Primary Examiner*—Edward K. Look
*Assistant Examiner*—John Ryznic
*Attorney, Agent, or Firm*—Kenyon & Kenyon

[57] ABSTRACT

The object of independent claims 1 and 3 relates to a magnetic clasp consisting of disk-shaped closure bodies, at least one of them being a permanent magnet, and one of the two closure bodies being developed as annular disk open on both sides. The first embodiment of the magnetic clasp has another body of magnetizable metal which is inserted with radial clearance into the two open annular disks, while the second embodiment of the magnetic clasp has only one open annular disk which is provided with a slot and into which the other closure body, developed as closed disk, is inserted with clearance in axial direction via the slot.

By these embodiments of the magnetic clasp there is created a construction which is protected against unintentional opening by exerting a pulling action on the closure bodies. Furthermore, since in both embodiments the clasp is open in axial direction towards both sides, the closing and opening thereof is substantially facilitated.

13 Claims, 1 Drawing Sheet

MAGNETIC CLASP

FIELD OF THE INVENTION

The present invention relates to a magnetic clasp, in particular for jewelry, garments and the like, in which substantially disk-shaped closure bodies of magnetizable metal are attached to the parts to be secured, the closure bodies being arranged parallel to each other in the closed position and at least one of them being a permanent magnet.

BACKGROUND OF THE INVENTION

In a magnetic clasp of this type known from U.S. Pat. No. 2,637,887 the one closure body is developed cup-shaped and serves to receive a magnet while the second closure body which is arranged on the magnet is developed as circular disk. In order to prevent the disk from sliding off from the magnet, the wall of the cup is made partially higher. This however requires that the disk-shaped closure body with its place of connection for the jewelry must be inserted very precisely since otherwise there is the danger over half the circumference of the cup-shaped closure body of unintentional detachment upon exerting a pulling force in radial direction. Furthermore, the manufacture of a cup-shaped closure body is expensive, this expense being further increased by the required machining of the cup edge.

SUMMARY OF THE INVENTION

The object of the present invention is to avoid the disadvantages of the known construction and to create a magnetic clasp of the type indicated above which, while of simple development, is secured against unintentional opening. The magnetic clasp according to the invention comprises closure bodies developed as annular disks which are open on both sides and which, in the closed position, jointly delimit a passage into which another body of magnetizable material is inserted with radial clearance. The other body is preferably a permanent magnet.

An alternative embodiment of the invention comprises two closure bodies one of which is developed as an annular disk which is open on both sides, and is provided with a radial slot and into which the other closure body, which is developed as a closed disk and is connected to the part to be secured via the slot, is inserted in axial direction with clearance.

By means of the invention there is created, with a simple development of the clasp, a construction which is completely secured against unintentional opening by the exertion of pulling action on the closure bodies since there is present in radial direction a form-locked blocking of the closure bodies which prevents mutual separation thereof. As a result, the clasp can be open in axial direction on both sides whereby the closing and opening is substantially facilitated.

A further embodiment of the invention comprises both closure bodies being permanent magnets and the axial magnetization of the inner closure body extends the opposite direction to the axial magnetization of the outer closure body.

A further embodiment of the invention comprises permanent magnet or magnets consisting of rare earths or an alloy of rare earth.

The invention will be explained in further detail below.

DETAILED DESCRIPTION OF THE INVENTION

Figure 1:
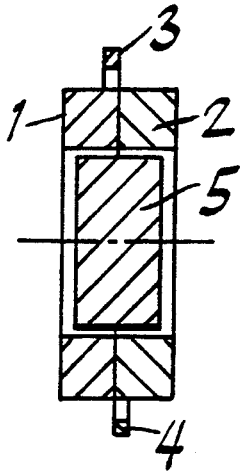
FIG. 1 is a cross sectional view of a first embodiment of the magnetic clasp of the invention.

According to FIG. 1, the magnetic clasp has two annular disks 1, 2 which are of equal size, open on both sides and of rectangular cross section. The annular disks 1, 2 consist of permanent magnets, in particular of an alloy of rare earths, and are in each case connected to one of the parts 3 or 4 to be secured, for instance the chain of a piece of jewelry, a half of a garment, etc. The two annular disks 1, 2 are axially magnetized in the same direction. Inside the two annular disks 1, 2 there is arranged, in the embodiment shown, a cylindrical, permanently magnetic body 5, for instance of the material used for the annular disks 1, 2, it being arranged freely movable with clearance with respect to the disks and with axial magnetization in direction opposite that of the annular disks 1, 2. After insertion of the body 5, the two annular disks 1, 2 which are connected to the parts 3, 4 to be secured, can advantageously no longer be separated from each other by the exertion of a pulling force on the disks.

Figure 2:
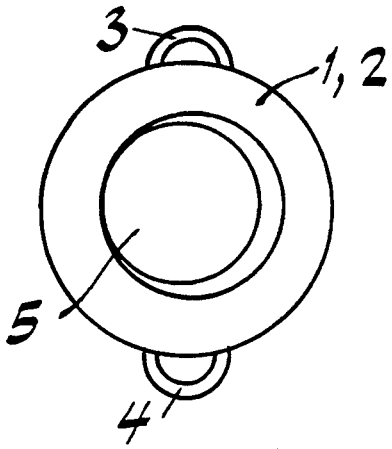
FIG. 2 is a top view of the magnetic clasp of FIG. 1.

In the embodiment according to FIGS. 1 and 2 only one of the two annular disks 1, 2 need be a permanent magnet; the disk can consist of magnetizable material but need not itself be magnetized. The same applies for the body 5. The locking action is then of course weaker.

If in the embodiment shown in FIGS. 1 and 2 both annular disks are formed of permanent magnets, they can also be arranged on a longer body 5 with axial magnetization in the same direction whereby they are held spaced apart from each other.

Figure 3:
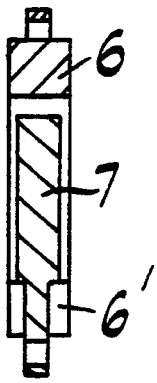
FIG. 3 is a cross sectional view of a second embodiment of the magnetic clasp of the invention.
Figure 4:
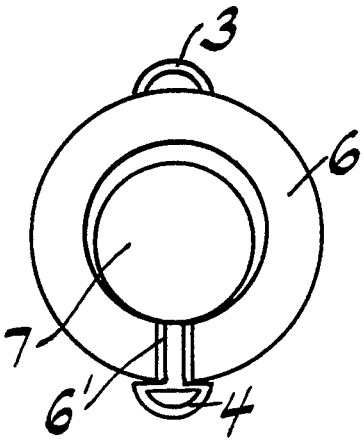
FIG. 4 is a top view of the magnetic clasp of FIG. 33.

In the embodiment shown in FIGS. 3 and 4, the magnetic clasp is formed of merely two parts namely an annular disk 6 which forms the one closure body, is open on both sides and of rectangular cross section, and a disk 7 of rectangular cross section which forms the other closure body which is arranged within the annular disk 6 with clearance in axial direction and connected via the slot 6' with the associated part of the piece of jewelry and the like. At least one of the two closure bodies 6, 7 is a permanent magnet, in particular of the material already mentioned above. The corresponding other closure body consists of a magnetizable material. If both closure bodies are permanent magnets, they are axially magnetized in opposite direction.

It is understood that the embodiments explained can be modified in different manner in particular with respect to the geometric shape of the disks. Furthermore, the closure bodies can be embedded in mounts which are attached to the parts to be secured.

I claim:

1. A magnetic clasp for securing parts having closed and open positions, comprising two annular disk shaped closure bodies open on both sides arranged substantially parallel to each other in the closed position defining a passage, each said closure body including an outer radial portion with attachment means thereon attachable to one of said parts, a magnetizable body inserted into said passage with radial clearance and at least one of the closure bodies being a permanent magnet.

2. The magnetic clasp of claim 1, wherein the magnetizable body is a permanent magnet.

3. The magnetic clasp of claim 1, wherein the clasp is a jewelry clasp.

4. The magnetic clasp of claim 1, wherein the clasp is a garment clasp.

5. The magnetic clasp of claim 2, wherein the permanent magnets are rare earth elements or alloys of rare earth elements.

6. A magnetic clasp for securing parts having closed and open positions, comprising an outer closure body open on both sides and having a radial slot, an inner closure body arranged substantially parallel to the outer closure body in the closed position and inserted into said radial slot with axial clearance, the closure bodies being attached to the parts being secured and at least one of the closure bodies being a permanent magnet.

7. The magnetic clasp of claim 6, wherein both closure bodies are permanent magnets having axial magnetizations and the axial magnetization of the inner closure body is directed opposite to the axial magnetization of the outer closure body.

8. The magnetic clasp of claim 7, wherein said outer closure body is an annular disk and said inner closure body is a closed disk.

9. The magnetic clasp of claim 6, wherein the clasp is a jewelry clasp.

10. The magnetic clasp of claim 6, wherein the clasp is a garment clasp.

11. The magnetic clasp of claim 6, wherein said permanent magnetic is a rare earth element or an alloy of a rare earth element.

12. The magnetic clasp of claim 8, wherein the permanent magnets are rare earth elements or alloys of rare earth elements.

13. The magnetic clasp of claim 1, wherein said permanent magnet is a rare earth element or an alloy of rare earth element.

* * * * *